US012365019B2

(12) United States Patent
Fujii et al.

(10) Patent No.: US 12,365,019 B2
(45) Date of Patent: Jul. 22, 2025

(54) PRESS FORMING METHOD AND PRESS FORMED PRODUCT

(71) Applicant: JFE STEEL CORPORATION, Tokyo (JP)

(72) Inventors: Yusuke Fujii, Tokyo (JP); Masaki Urabe, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 339 days.

(21) Appl. No.: 17/914,990

(22) PCT Filed: Dec. 1, 2020

(86) PCT No.: PCT/JP2020/044608
§ 371 (c)(1),
(2) Date: Sep. 27, 2022

(87) PCT Pub. No.: WO2021/205692
PCT Pub. Date: Oct. 14, 2021

(65) Prior Publication Data

US 2023/0150002 A1 May 18, 2023

(30) Foreign Application Priority Data

Apr. 9, 2020 (JP) ..... 2020-070141
Apr. 9, 2020 (JP) ..... 2020-070144

(51) Int. Cl.
*B21D 22/26* (2006.01)
*B21D 22/20* (2006.01)
(Continued)

(52) U.S. Cl.
CPC ..... *B21D 22/26* (2013.01); *B21D 22/20* (2013.01); *B21D 24/04* (2013.01); *B21D 53/88* (2013.01)

(58) Field of Classification Search
CPC ..... B21D 22/02; B21D 22/20; B21D 22/22; B21D 22/26; B21D 53/88; B21D 24/04; B62D 25/02; B60J 1/007; Y10T 428/1241
(Continued)

(56) References Cited

U.S. PATENT DOCUMENTS 5,953,951 A 9/1999 Fujimoto et al.
9,718,499 B2 8/2017 Tanaka et al.
(Continued)

FOREIGN PATENT DOCUMENTS

CN 1198969 A 11/1998
CN 104870118 A 8/2015
(Continued)

OTHER PUBLICATIONS

Feb. 9, 2021 International Search Report issued in International Patent Application No. PCT/JP2020/044608.
(Continued)

*Primary Examiner* — Christopher L Templeton
*Assistant Examiner* — Matthew Stephens
(74) *Attorney, Agent, or Firm* — Oliff PLC

(57) ABSTRACT

A press forming method includes: press forming a press formed product including a top portion, a side wall portion continuous from the top portion through a punch shoulder portion, and a flange portion continuous from the side wall portion through a die shoulder portion, the press formed product including a curved portion that is concave and curved in a top view; and increasing a bending radius of the punch shoulder portion in the curved portion from a center of a curve toward an end side of the curve.

17 Claims, 11 Drawing Sheets

(a) PERSPECTIVE VIEW (b) TOP VIEW

(51) Int. Cl.
*B21D 24/04* (2006.01)
*B21D 53/88* (2006.01)

(58) Field of Classification Search
USPC ..... 428/603; 296/96.21, 146.15, 191
See application file for complete search history.

(56) References Cited

U.S. PATENT DOCUMENTS

| | | | | |
|---|---|---|---|---|
| 10,596,613 | B2 | 3/2020 | Nishimura et al. | |
| 10,946,427 | B2 | 3/2021 | Miyagi et al. | |
| 11,135,633 | B2 | 10/2021 | Tanaka et al. | |
| 2012/0297853 | A1 | 11/2012 | Tanaka et al. | |
| 2015/0336619 | A1 | 11/2015 | Tanaka et al. | |
| 2016/0082495 | A1* | 3/2016 | Miyagi | B21D 22/26 72/352 |
| 2017/0291208 | A1* | 10/2017 | Nishimura | B21D 5/01 72/352 |
| 2018/0085811 | A1* | 3/2018 | Fujii | B21D 24/005 72/352 |
| 2019/0030583 | A1* | 1/2019 | Nishimura | B21D 24/005 72/352 |
| 2019/0160510 | A1 | 5/2019 | Tanaka et al. | |
| 2020/0346267 | A1* | 11/2020 | Otsuka | B21D 22/022 72/352 |
| 2021/0316352 | A1 | 10/2021 | Shinmiya et al. | |

FOREIGN PATENT DOCUMENTS

| | | | |
|---|---|---|---|
| CN | 105188982 | A | 12/2015 |
| CN | 107073547 | A | 8/2017 |
| EP | 3 970 873 | A1 | 3/2022 |
| JP | 2009-202189 | A | 9/2009 |
| JP | 2011-195103 | A | 10/2011 |
| JP | 5020858 | B2 | 9/2012 |
| JP | 5168429 | B2 | 3/2013 |
| JP | 2016-175089 | A | 10/2016 |
| JP | 6028956 | B1 | 11/2016 |
| JP | 2019-171440 | A | 10/2019 |
| WO | 2017/002253 | A1 | 1/2017 |
| WO | 2018/003755 | A1 | 1/2018 |
| WO | 2018-075641 | A | 5/2018 |
| WO | 2019/225661 | A1 | 11/2019 |

OTHER PUBLICATIONS

Aug. 30, 2023 Extended Search Report issued in European Patent Application No. 20930002.9.
Feb. 14, 2025 Office Action issued in Chinese Patent Application No. 202080099142.1.
Apr. 21, 2025 Office Action issued in U.S. Appl. No. 18/036,298.

* cited by examiner (a) PERSPECTIVE VIEW (b) TOP VIEW (a) PERSPECTIVE VIEW (b) TOP VIEW (a) PERSPECTIVE VIEW (b) TOP VIEW (a) PERSPECTIVE VIEW (b) TOP VIEW (a) PERSPECTIVE VIEW (b) TOP VIEW

PRESS FORMING METHOD AND PRESS FORMED PRODUCT

FIELD

The present invention relates to a press forming method and a press formed product. In particular, the present invention relates to a press forming method for a press formed product and the press formed product, the press formed product having a top portion, a side wall portion continuous from the top portion through a punch shoulder portion, and a flange portion continuous from the side wall portion through a die shoulder portion, the press formed product including a curved portion that is concave and curved in the top view.

BACKGROUND

Press forming is a manufacturing method by which metal parts can be manufactured at low cost and in a short time, and is used to manufacture many automotive parts. In recent years, higher-strength metal sheets have been used in automotive parts to improve collision safety of the automobile and realize weight reduction of the automotive body. Main problems in press forming high-strength metal sheets include a fracture due to reduced elongation and wrinkles due to increased yield strength.

For example, in press forming to create, as a target shape, a press formed product 101 having a concave curved side wall portion 107 in the top view as illustrated in FIG. 9, a flange portion 111 in a curved portion 113 is pulled in the circumferential direction, to cause a fracture easily. In addition, deformation, which is shrinkage in the circumferential direction as the reaction force, occurs at a top portion 103 and a punch shoulder portion 105 in the curved portion 113, to cause wrinkles easily. This deformation is called stretch flange deformation. Thus, preventing occurrence of a fracture and wrinkles in such stretch flange deformation is important in press forming the press formed product 101.

As a technique for preventing a fracture and wrinkles of a press formed product that is concave and curved in the top view, Patent Literature 1, for example, discloses a method for press forming, from a metallic sheet, L-shaped parts having a top portion and a side wall portion that is connected to the top portion through a bent portion having a portion curved in an arc shape and that has a flange portion on the opposite side of the bent portion. According to the press forming method, a portion of the metallic sheet corresponding to the top portion is pressurized by a pad, an end of a portion of the metallic sheet corresponding to a lower side of the L shape of the L-shaped part is allowed to slide (in-plane movement), and the portion corresponding to the lower side of the L shape is drawn into the side wall portion side to form the side wall portion and the flange portion, thereby enabling prevention of a fracture in the flange portion and wrinkles in the top portion.

In addition, Patent Literature 2 discloses a press forming method for press forming a part having a hat shaped or U-shaped sectional shape and having a curved portion curved along the longitudinal direction and straight side portions connecting to both ends of the curved portion. According to the press forming method, a fracture due to stretch flange deformation can be prevented by causing a material movement to mitigate tensile deformation in the circumferential direction that occurs in the flange portion of the curved portion.

CITATION LIST

Patent Literature

Patent Literature 1: Japanese Patent No. 5168429
Patent Literature 2: Japanese Patent No. 6028956

SUMMARY

Technical Problem

In the technique disclosed in Patent Literature 1, as illustrated in FIG. 10, the movement directions of a material of a blank (metal sheet) flowing out from the top portion 103 to the flange portion 111 side do not coincide with the direction (circumferential dotted line) in which the material is pulled by the stretch flange deformation. When the material movements of the blank are decomposed into vectors in two directions as illustrated in FIG. 11, the movements (solid black arrows in the figure) from the end sides of the curved portion 113 toward the center are effective in preventing a fracture of the flange portion 111 due to stretch flange deformation, while the movements (black broken-line arrows in the figure) from the top portion 103 toward the side wall portion 107 do not contribute to preventing stretch flange deformation. Furthermore, even for the material movements toward the center of the curved portion 113, there is concern that material movements (white painted arrows in the figure) near the center of the curved portion 113 may induce wrinkles near the top portion 103 and the punch shoulder portion 105.

Although the technique disclosed in Patent Literature 1 prevents wrinkles in the top portion by pressurizing the portion of the metallic sheet corresponding to the top portion with the pad, a higher-strength steel sheet requires a greater load of the pad that pressurizes wrinkles, and there is concern that a pressure generating device such as a gas cylinder installed inside a die may expand to immense size. As a result, problems arise in that space to install the pad may not be provided in the die or upsizing the die increase costs. Also, when the technique of Patent Literature 1 is applied to press forming of the press formed product 101 illustrated in FIG. 9, wrinkles cannot be prevented at the punch shoulder portion 105 because the punch shoulder portion 105 cannot be pressurized with the pad.

Furthermore, according to the techniques disclosed in Patent Literatures 1 and 2, in a press formed product in which a bead shape needs to be given to the top portion 103 in the curved portion 113, for example, the material in the portion corresponding to the top portion 103 in the curved portion 113 illustrated in FIG. 11 may fail to move to the flange portion 111 where stretch flange deformation occurs, so that it is difficult to prevent wrinkles.

The present invention is made in view of the above problems, and an object of the present invention is to provide a press forming method and a press formed product, the press forming method by which, in the press formed product that has a top portion, a side wall portion, and a flange portion and that is concave and curved in the top view, a fracture can be prevented in the flange portion where stretch flange deformation occurs and wrinkles can be prevented in the top portion and the punch shoulder portion on the flange portion side.

Solution to Problem

A press forming method according to a first aspect of the present invention includes: press forming a press formed product including a top portion, a side wall portion continuous from the top portion through a punch shoulder portion, and a flange portion continuous from the side wall portion through a die shoulder portion, the press formed product including a curved portion that is concave and curved in a top view; and increasing a bending radius of the punch shoulder portion in the curved portion from a center of a curve toward an end side of the curve.

A bending radius of the die shoulder portion in the curved portion may be decreased from the center of the curve toward the end side of the curve.

A minimum bending radius of the die shoulder portion may be made smaller than a minimum bending radius of the punch shoulder portion.

A rotational motion restraining shape portion that restrains rotational motion of a blank during a press forming process may be formed on the top portion on the end side of the curve.

A flange width of the flange portion in the curved portion may be made wider in the center of the curve than on the end side of the curve.

A blank to be used for press forming of the press formed product may be a metal sheet having a tensile strength of 440 MPa grade or higher to 1600 MPa grade or lower.

A press forming method according to a second aspect of the present invention includes press forming an intermediate formed product to have a target shape, the intermediate formed product being a press formed product press formed by the press forming method according to the first aspect of the present invention, wherein the intermediate formed product has a bending radius of the punch shoulder portion on the end side of the curved portion larger than the target shape does.

A press formed product according to the present invention includes: a top portion; a side wall portion continuous from the top portion through a punch shoulder portion; a flange portion continuous from the side wall portion through a die shoulder portion; and a curved portion that is concave and curved in a top view, wherein a bending radius of the punch shoulder portion in the curved portion is increased from a center of a curve toward an end side of the curve.

A bending radius of the die shoulder portion in the curved portion may be decreased from the center of the curve toward the end side of the curve.

A minimum bending radius of the die shoulder portion may be smaller than a minimum bending radius of the punch shoulder portion.

A rotational motion restraining shape portion that restrains rotational motion of a blank during a press forming process may be formed on the top portion on the end side of the curve.

A width of the flange portion in the curved portion may be wider in the center of the curve than on the end side of the curve.

The press formed product may be obtained by press forming a metal sheet having a tensile strength of 440 MPa grade or higher to 1600 MPa grade or lower.

Advantageous Effects of Invention

According to the present invention, a material can be moved from the top portion on the end sides of the curve toward the flange portion in the center of the curve, which can prevent a fracture in the flange portion of the curved portion and can also prevent wrinkles in the top portion and the punch shoulder portion on the flange portion side of the curved portion.

DESCRIPTION OF EMBODIMENTS

A press forming method and a press formed product according to an embodiment of the present invention will be described below with reference to FIG. 1 to FIG. 8.

Figure 1:
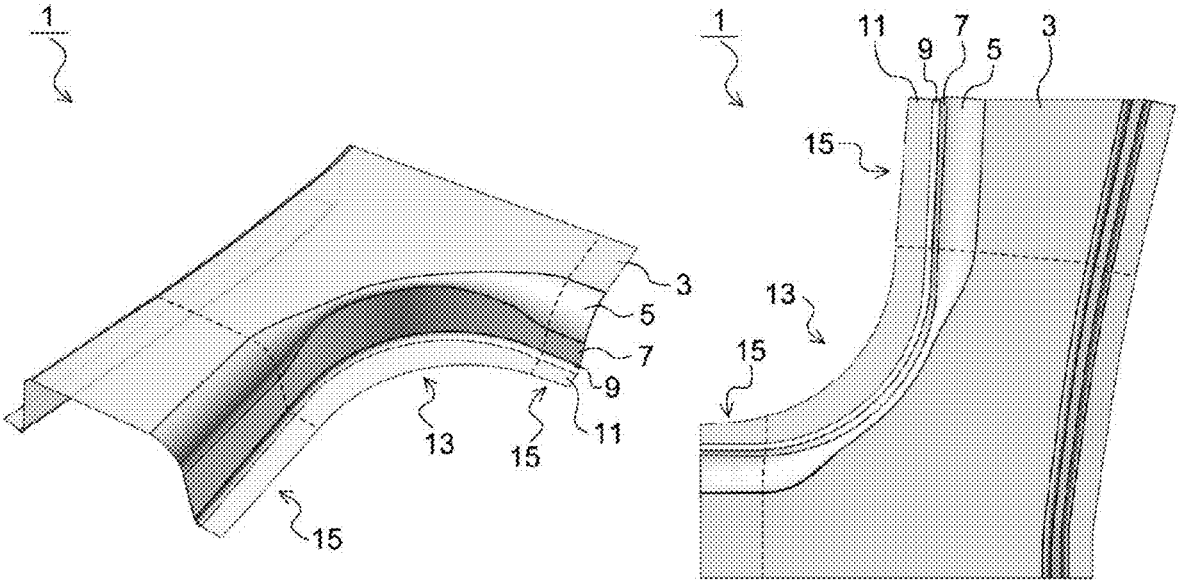
FIG. 1 is a diagram illustrating an example of a press formed product to be formed in a press forming method according to an embodiment of the present invention ((a) perspective view, (b) top view).

As illustrated in FIG. 1 as an example, the press forming method and the press formed product according to the present embodiment press form a press formed product 1 that has a top portion 3, a side wall portion 7 continuous from the top portion 3 through a punch shoulder portion 5, and a flange portion 11 continuous from the side wall portion 7 through a die shoulder portion 9, and that includes a curved portion 13 that is concave and curved in the top view and straight portions 15 extending straight from both ends (broken lines in FIG. 1) of a curve in the curved portion 13. The punch shoulder portion 5 in the curved portion 13 has a bending radius that increases from the center of a curve toward the end sides of the curve.

Reasons why both a fracture of the flange portion 11 and wrinkles of the top portion 3 and the punch shoulder portion 5 in the curved portion 13 of the press formed product 1 can be prevented in the press forming method and the press formed product according to the present embodiment will be described with reference to FIG. 2 that schematically illustrates material movements during a press forming process. The broken lines in FIG. 2 indicate both ends of the curve (boundaries between the curved portion 13 and the straight portions 15).

Figure 2:
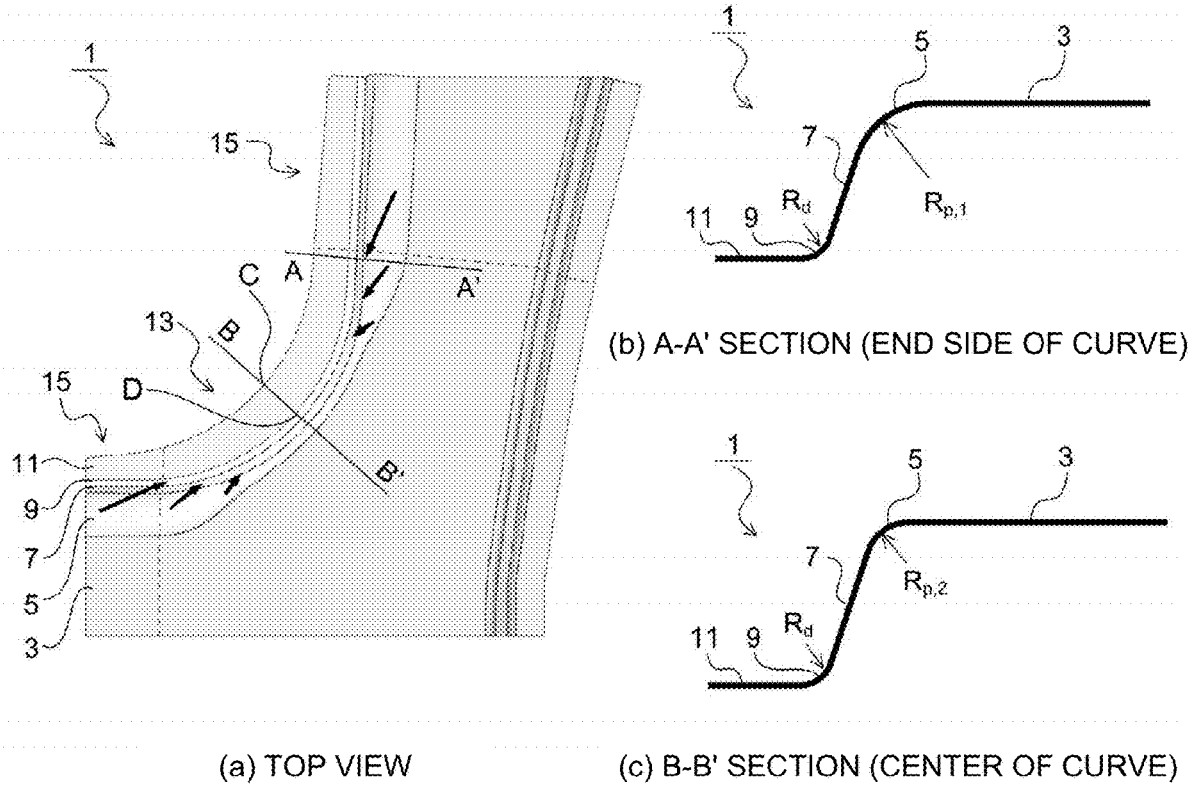
FIG. 2 is a diagram explaining a reason why a fracture can be prevented by the press forming method according to the embodiment of the present invention ((a) top view, (b) sectional view of a curve on the end side, (c) sectional view of the center of the curve).

The punch shoulder portion 5 has a bending radius that increases from the center (B-B' section) of the curve toward the end side (A-A' section) of the curve in such a manner that a bending radius $R_{p,1}$ at the end of the curve (FIG. 2(*b*)) is larger than a bending radius $R_{p,2}$ in the center of the curve (FIG. 2(*c*)). Thus, as indicated by the black arrows in FIG. 2, the material easily moves along the ridge direction (perpendicular to the paper) from the end sides toward the center of the curve of the punch shoulder portion 5, and is drawn into the flange portion 11 side in the center of the curve. In contrast, the center of the curve of the punch shoulder portion 5 has a smaller bending radius than the end sides of the curve, so the material is less likely to move in the ridge direction during the press forming process.

Thus, during the press forming process of the press formed product 1, the material can be moved from the top portion 3 on the end side of the curve toward the flange portion 11 in the center of the curve, which can prevent a fracture of the flange portion 11 in the curved portion 13 and can also prevent wrinkles in the top portion 3 and the punch shoulder portion 5 of the curved portion 13.

In the press forming method according to the present embodiment, the minimum bending radius of the die shoulder portion 9 is preferably smaller than the minimum bending radius of the punch shoulder portion 5. The minimum bending radius of the die shoulder portion 9 is the smallest bending radius of the die shoulder portion 9 in the curved portion 13. In the press formed product 1, the minimum bending radius of the die shoulder portion 9 is $R_d$ because the bending radius $R_d$ of the die shoulder portion 9 is constant from the center of the curve to the end sides of the curve, as illustrated in FIG. 2. Meanwhile, the minimum bending radius of the punch shoulder portion 5 is the smallest bending radius of the punch shoulder portion 5 in the curved portion 13. In the press formed product 1, the minimum bending radius of the punch shoulder portion 5 is the bending radius $R_{p,2}$ in the center of the curve because the bending radius of the punch shoulder portion 5 increases from the center of the curve toward the end sides of the curve, as illustrated in FIG. 2. In this manner, by making the minimum bending radius ($=R_d$) of the die shoulder portion 9 smaller than the minimum bending radius ($=R_{p,2}$) of the punch shoulder portion 5, the material movements at the die shoulder portion 9 can be restrained during the press forming process; accordingly the material can be drawn strongly from the top portion 3 side to the flange portion 11 side during the press forming process. As a result, a fracture of the flange portion 11 and wrinkles of the top portion 3 and the punch shoulder portion 5 can be further prevented in the center of the curve.

The press forming method and the press formed product according to the present embodiment is such that the bending radius of the punch shoulder portion 5 in the curved portion 13 is increased from the center of the curve toward the ends of the curve, as in the press formed product 1 illustrated in FIG. 1. The press forming method and the press formed product according to another aspect of the present embodiment may be such that the bending radius of a punch shoulder portion 25 in a curved portion 33 is increased from the center of the curve toward the end sides of the curve, and that the bending radius of a die shoulder portion 29 in the curved portion 33 is decreased from the center of the curve toward the end sides of the curve in the curved portion 33, as in a press formed product 21 illustrated in FIG. 3 as an example.

The operation and effect of decreasing the bending radius of the die shoulder portion 29 from the center of the curve toward the end sides of the curve in the curved portion 33 will be described with reference to FIG. 4 that schematically illustrates material movements during a press forming process of the press formed product 21. The broken lines in FIG. 4 indicate both ends of the curve (boundaries between the curved portion 33 and straight portions 35).

Figure 4:
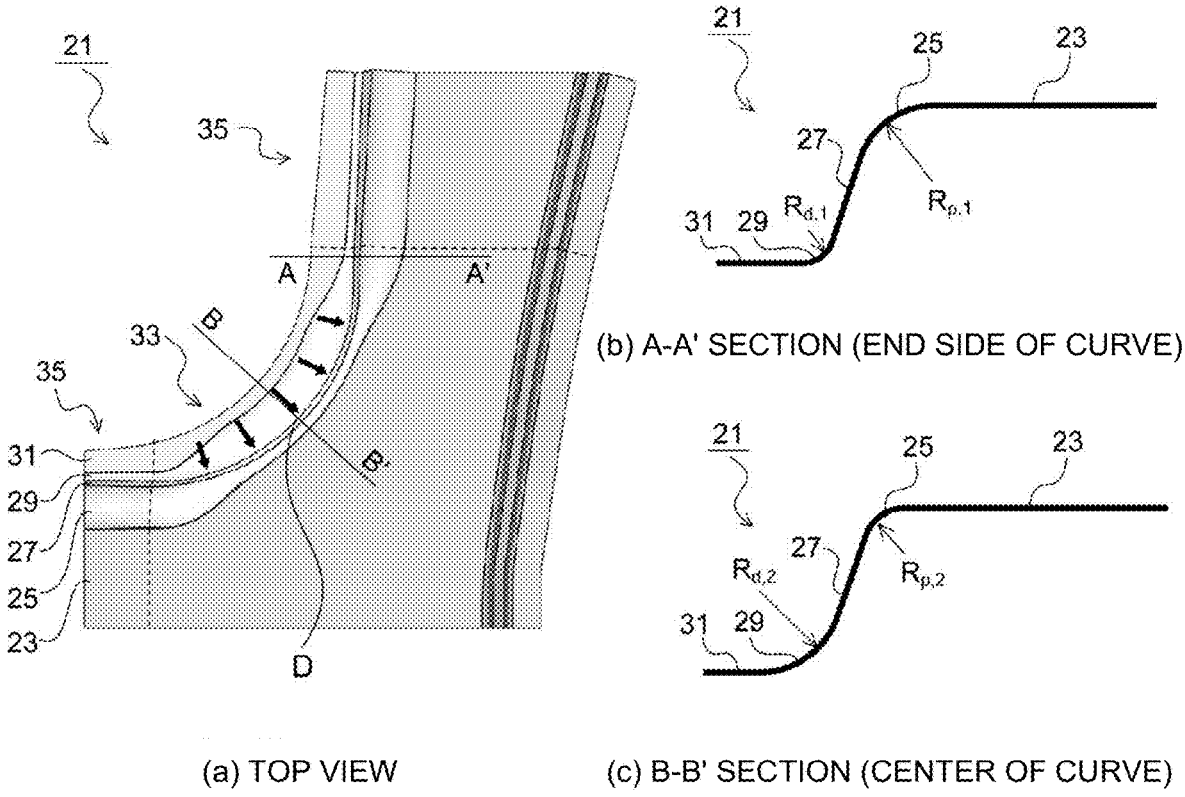
FIG. 4 is a diagram explaining a reason why wrinkles can be prevented by the press forming method according to the another aspect of the embodiment of the present invention ((a) top view, (b) sectional view of a curve on the end side, (c) sectional view in the center of the curve).

The die shoulder portion 29 has a bending radius $R_{d,1}$ on the end side (A-A' section) of the curve (FIG. 4(*b*)) that is smaller than a bending radius $R_{d,2}$ in the center (B-B' section) of the curve (FIG. 4(*c*)). This facilitates material movements toward a curved concave portion (D illustrated in FIG. 4(*a*), the root of a flange portion 31 joining to a side wall portion 27 in the curve) in stretch flange deformation, and also inhibits a material movement that pulls in the circumferential direction of the curve in the flange portion 31, thereby enabling prevention of a flange fracture.

As a result, a fracture of the flange portion 31 in the curved portion 33 can be further prevented during the press forming process of the press formed product 21.

In the press forming method and the press formed product according to another aspect of the present embodiment, the minimum bending radius of the die shoulder portion 29 in the curved portion 33 is preferably smaller than the minimum bending radius of the punch shoulder portion 25. The minimum bending radius of the die shoulder portion 29 is the smallest bending radius of the die shoulder portion 29 in the curved portion 33, and is the bending radius $R_{d,1}$ on the end side of the curve, as illustrated in FIG. 4(*b*). Meanwhile, the minimum bending radius of the punch shoulder portion 25 is the smallest bending radius of the punch shoulder portion 25 in the curved portion 33, and is the bending radius $R_{p,2}$ in the center of the curve, as illustrated in FIG. 4(*c*). In this manner, by making the minimum bending radius ($=R_{d,1}$) of the die shoulder portion 29 smaller than the minimum bending radius ($=R_{p,2}$) of the punch shoulder portion 25, the bending radius $R_{p,1}$ on the end side of the curve of the punch shoulder portion 25 is even larger than the minimum bending radius $R_{p,2}$ (in the center of the curve) of the punch shoulder portion 25, so that the material can be drawn strongly from a top portion 23 side to the flange portion 31 side during the press forming process. As a result, a fracture of the flange portion 31 and wrinkles of the top portion 23 and the punch shoulder portion 25 can be further prevented in the curved portion 33.

Figure 3:
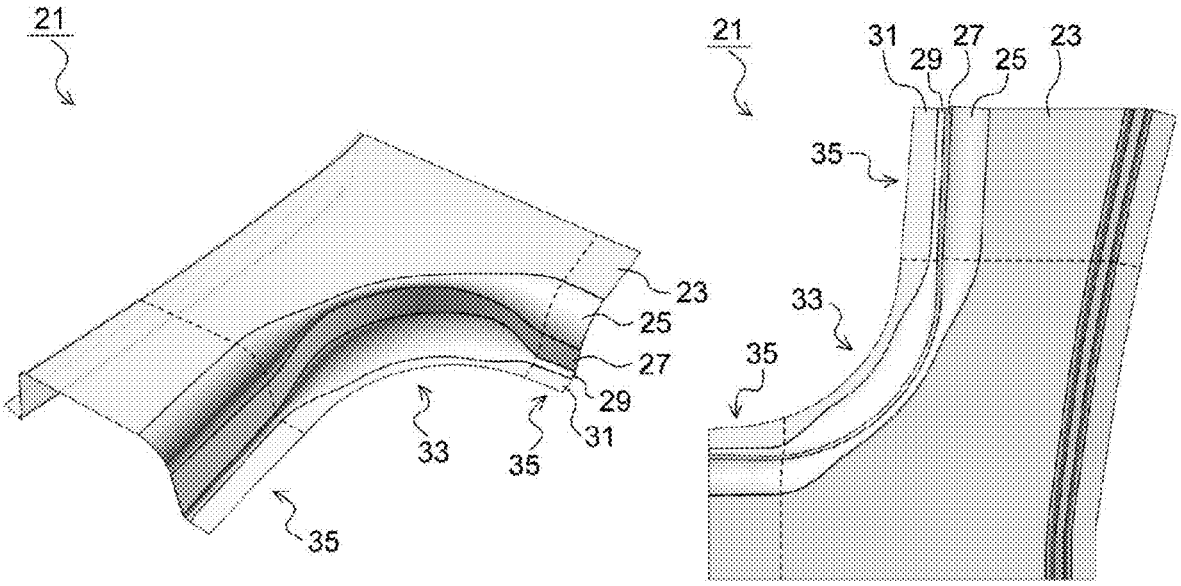
FIG. 3 is a diagram illustrating an example of a press formed product to be formed in a press forming method according to another aspect of the embodiment of the present invention ((a) perspective view, (b) top view).

In the above description, the bending radius of the punch shoulder portion 5 has been changed as illustrated in FIG. 1, and the bending radii of the punch shoulder portion 25 and the die shoulder portion 29 have also been changed as illustrated in FIG. 3. The press forming method and the press formed product according to the present invention may form a rotational motion restraining shape portion 57 in a top portion 43 on the end sides of a curved portion 53 and straight portions 55, the rotational motion restraining shape portion 57 restraining the rotational motion of the blank in the horizontal plane parallel to the top portion 43 during the press forming process, like a press formed product 41 illustrated in FIG. 5.

The rotational motion restraining shape portion 57 is a bent shape formed between a side wall portion 59 and the top portion 43, the side wall portion 59 continuing to the opposite side of a side wall portion 47 of the straight portions 55. A punch shoulder portion 45 is formed so that the bending radius increases from the center of the curve toward the end sides, like the punch shoulder portion 5 of the press formed product 1 described above.

In this manner, forming the rotational motion restraining shape portion 57 during the press forming process enables the material to be moved from the top portion 43 of the end sides of the curve and the straight portions 55 to a flange portion 51 in the center of the curve through the punch shoulder portion 45, while the rotational motion of the blank in the horizontal plane parallel to the top portion 43 is restrained during the press forming process. In addition, wrinkles of the top portion 43 and the punch shoulder portion 45 can be sufficiently prevented in the curved portion 53.

Figure 5:
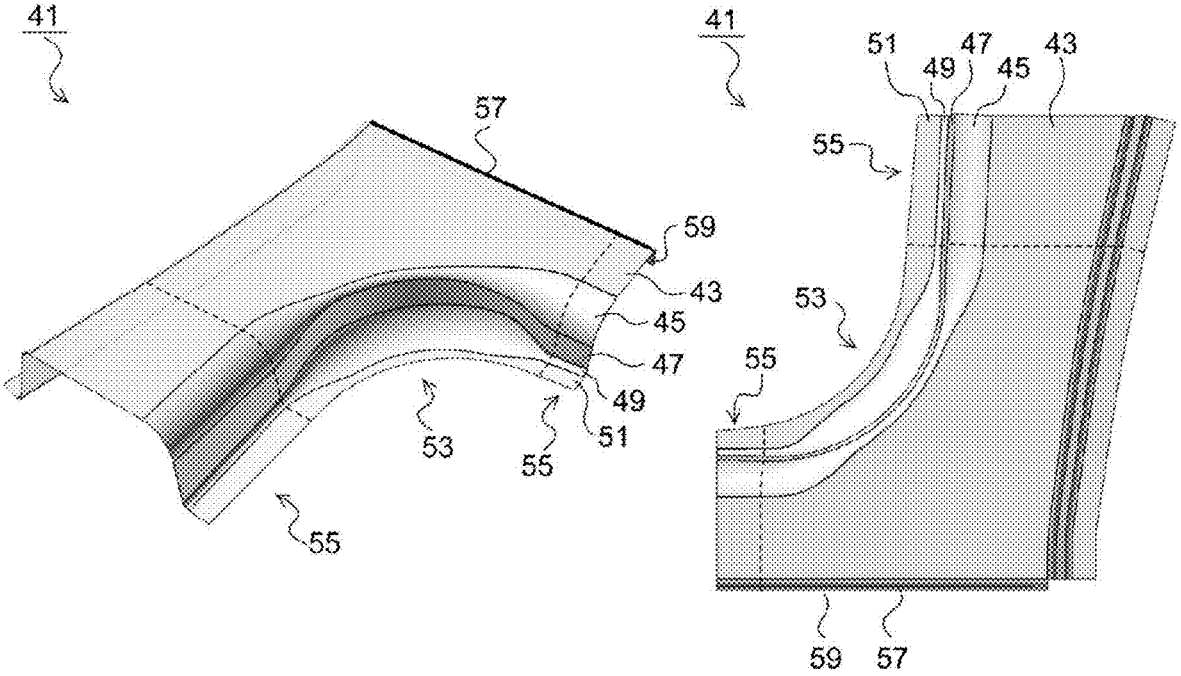
FIG. 5 is a diagram illustrating an example of a press formed product that is to be formed in the press forming method according to the embodiment of the present invention, and the shape of which is formed by a side wall portion formed on a blank end to restrain rotational motion in the horizontal plane parallel to the top portion.
Figure 6:
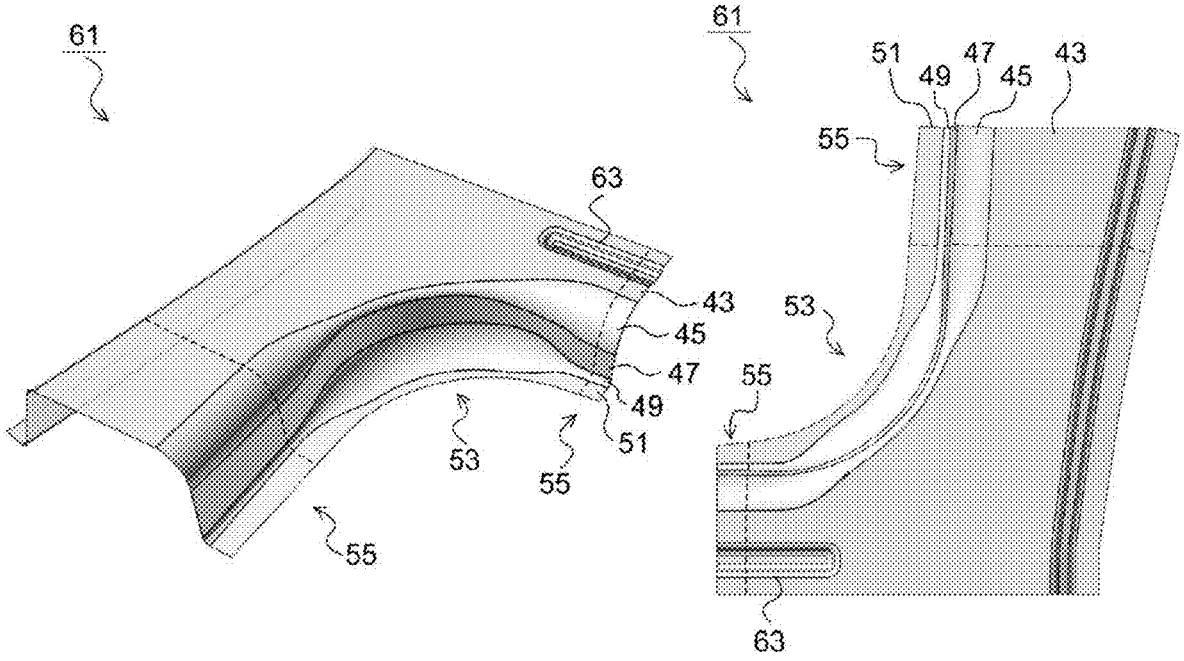
FIG. 6 is a diagram illustrating another example of the press formed product that is to be formed in the press forming method according to the embodiment of the present invention and the shape of which is formed by a bead to restrain rotational motion in the horizontal plane parallel to the top portion.

The present invention is not limited to the rotational motion restraining shape portion 57 having the shape illustrated in FIG. 5, and a shape may be possible that can restrain the rotational motion of the blank in the horizontal plane parallel to the top portion 43 during the press forming process, like a rotational motion restraining shape portion 63 having a bead shape formed on the top portion 43 of a press formed product 61 in FIG. 6. In a case where a bead is formed on the top portion 43, the shape of the bead is not limited to being concave like the rotational motion restraining shape portion 63, but may also be convex.

Although the rotational motion restraining shape portion 57 illustrated in FIG. 5 and the rotational motion restraining shape portion 63 illustrated in FIG. 6 are formed from the ends of the curved portion 53 to the straight portions 55, this does not exclude forming a rotational motion restraining shape portion only at the ends of the curved portion 53 or only at the straight portions 55 for the position where the rotational motion restraining shape portion is formed.

Figure 7:
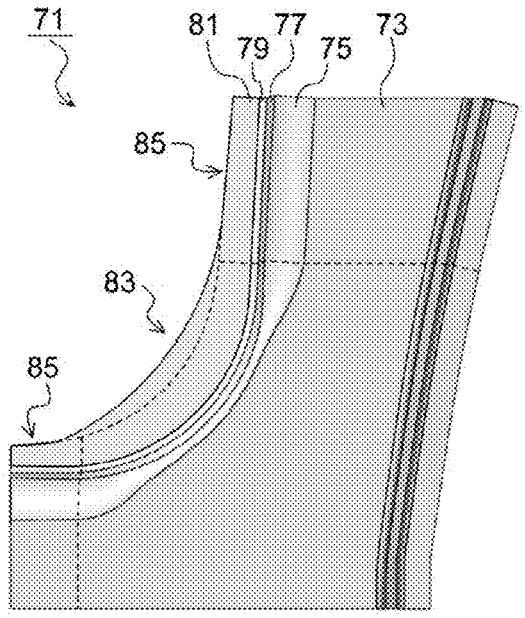
FIG. 7 is a diagram illustrating an example of a press formed product that is to be formed in the press forming method according to the embodiment of the present invention and that has a wider flange width of a flange portion in the center of the curve.

Furthermore, the press forming method and the press formed product according to the present invention may have a wider flange width of a flange portion 81 in the center of a curved portion 83 than on the end sides of the curve, as in a press formed product 71 illustrated in FIG. 7, in addition to the bending radius of the punch shoulder portion and the die shoulder portion described above.

Figure 8:
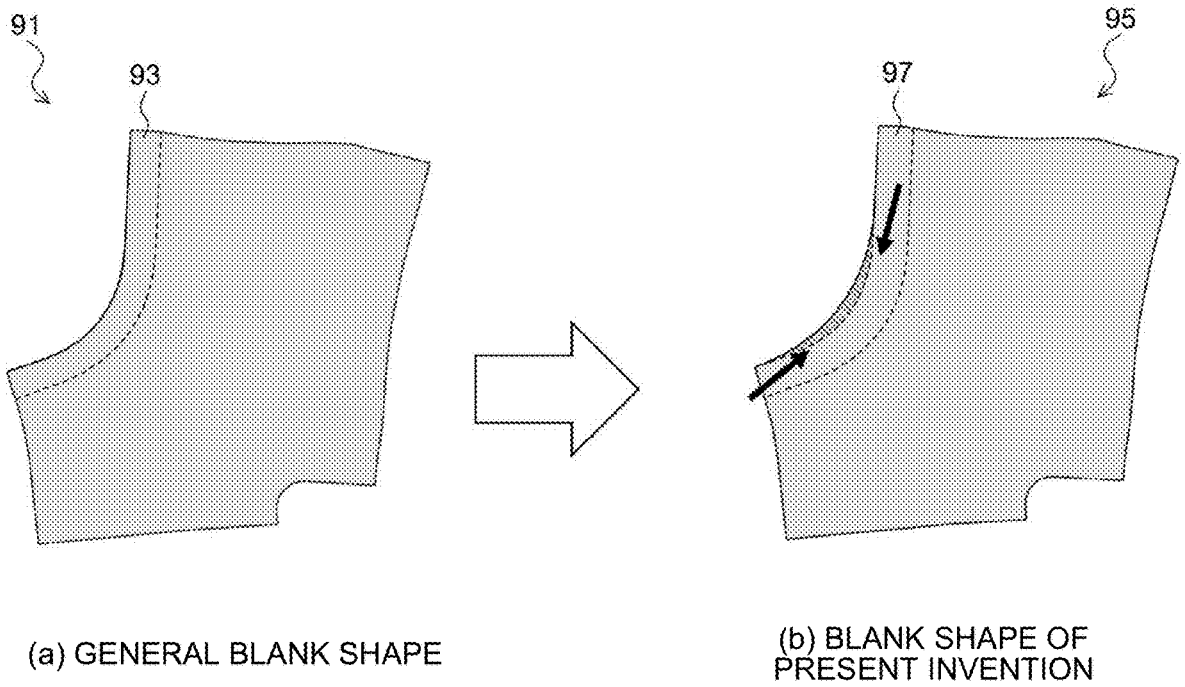
FIG. 8 is a diagram explaining a reason why a fracture can be prevented in the press formed product having a wider flange of the flange portion in the center of the curve by the press forming method according to the embodiment of the present invention.

The operation and effect of press forming the press formed product 71 illustrated in FIG. 7 are as follows. For example, the press formed product 1 described above is obtained by press forming a blank 91 having such a shape as the shape of the press formed product 1 when press formed, as illustrated in FIG. 8(*a*). In this case, a flange equivalent portion 93 in the blank 91 becomes the flange portion 11 (FIG. 1) of the press formed product 1.

In contrast, the press formed product 71 illustrated in FIG. 7 is press formed using a blank 95 with increased excess metal (hatched area in the figure) in a flange equivalent portion 97 corresponding to the flange portion 81, as illustrated in FIG. 8(*b*).

When the blank 95 is used to press form the press formed product 71, the material of the flange portion 81 in the curved portion 83 is less stretchable, so that the material insufficient to form the flange portion 81 is drawn in from a top portion 73 side through a punch shoulder portion 75 and a side wall portion 77. As a result, there is more material toward the center of the curve in the curved portion 83, and a fracture of the flange portion 81 can be further prevented.

When the flange width of the flange portion 81 in the curved portion 83 is made wider in the center of the curve than on the end sides of the curve, as in the press formed product 71 illustrated in FIG. 7, the maximum width of the flange in the center of the curve is preferably 1.1 to 1.5 times the flange width on the end sides.

If the flange width in the center of the curve is less than 1.1 times the flange width on the end sides, the force that draws the material from the top portion 73 to the flange portion 81 side during the press forming process does not increase much. If the flange width in the center of the curve is more than 1.5 times the flange width on the end sides, the flange width of the flange portion 81 is too wide and becomes an obstacle when joined to other parts, so the flange portion 81 is cut off to make the flange width narrower in a downstream step, which increases the number of work steps and further reduces the yield rate.

The press forming method and the press formed product according to the embodiment of the present invention are intended to form the press formed product 1 having the straight portions 15 extending from both ends of the curve of the curved portion 13, as illustrated in FIG. 1, for example. The present invention may press form a press formed product having only a curved portion or a press formed product having a straight portion extending from only one end of the curve, and it does not matter whether there is a straight portion.

In the above description, the bending radius of the punch shoulder portion is increased from the center of the curve toward both end sides, but may be increased from the center of the curve toward either end side.

Similarly, the curvature radius of the curve of the die shoulder portion is decreased from the center of the curve to both end sides, but may be decreased toward either end side.

The above description has illustrated by example the specific aspects of the present invention on the basis of the embodiment of the present invention. The present invention also includes, for example, the press formed product 1 illustrated in FIG. 1 as an intermediate formed product, which is then press formed into a target shape. The press formed product 1 serving as the intermediate formed product should have a bending radius of the punch shoulder portion 5 on the end sides of the curved portion 13 larger than the target shape does. In other words, the present invention includes a press forming method made up of two steps: a step of press forming the press formed product 1, which is an intermediate formed product; and a step of press forming the press formed product 1 into a press formed product having a target shape.

Figure 9:
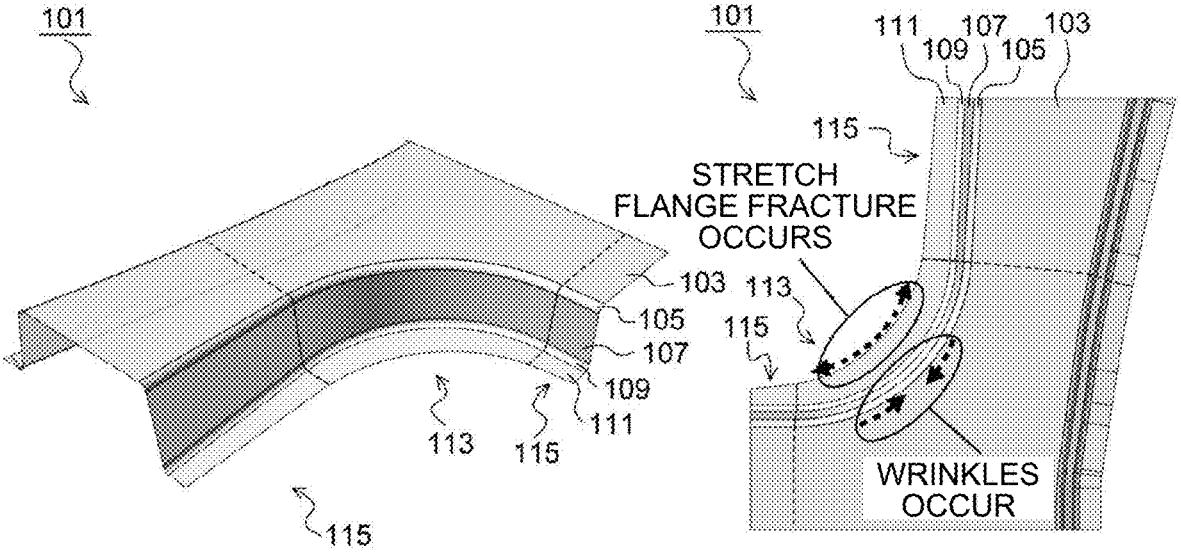
FIG. 9 is a diagram explaining a fracture and wrinkles that occur in press forming of a press formed product having a portion that is concave and curved in the top view.
Figure 10:
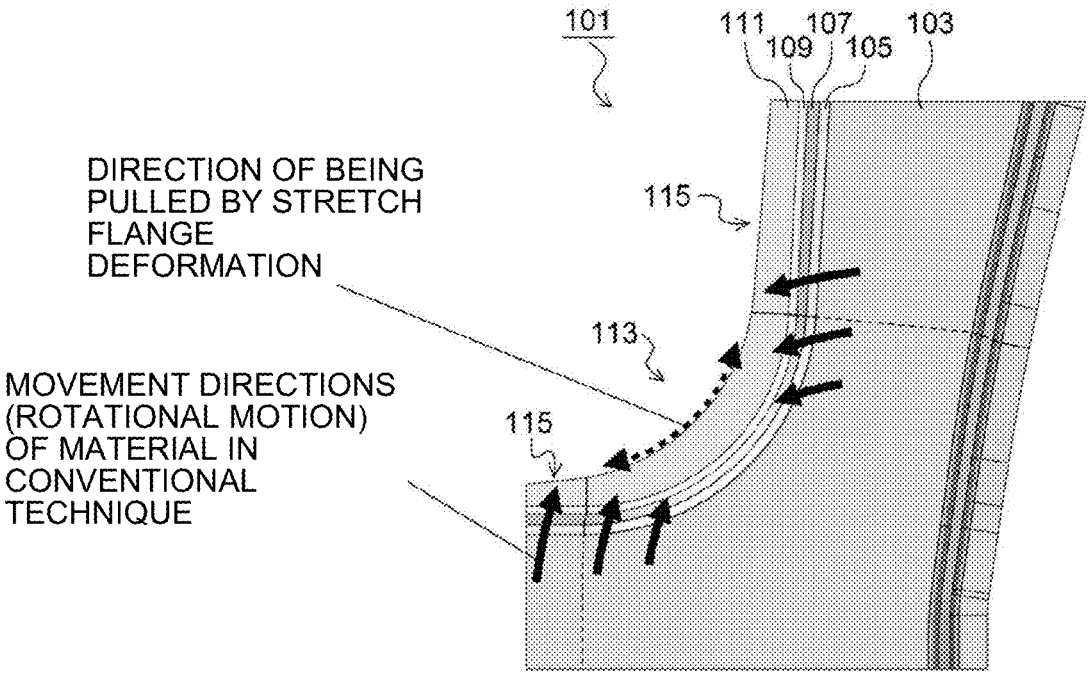
FIG. 10 is a diagram explaining a mechanism by which a fracture occurs in the process of press forming a press formed product that is concave and curved in the top view.
Figure 11:
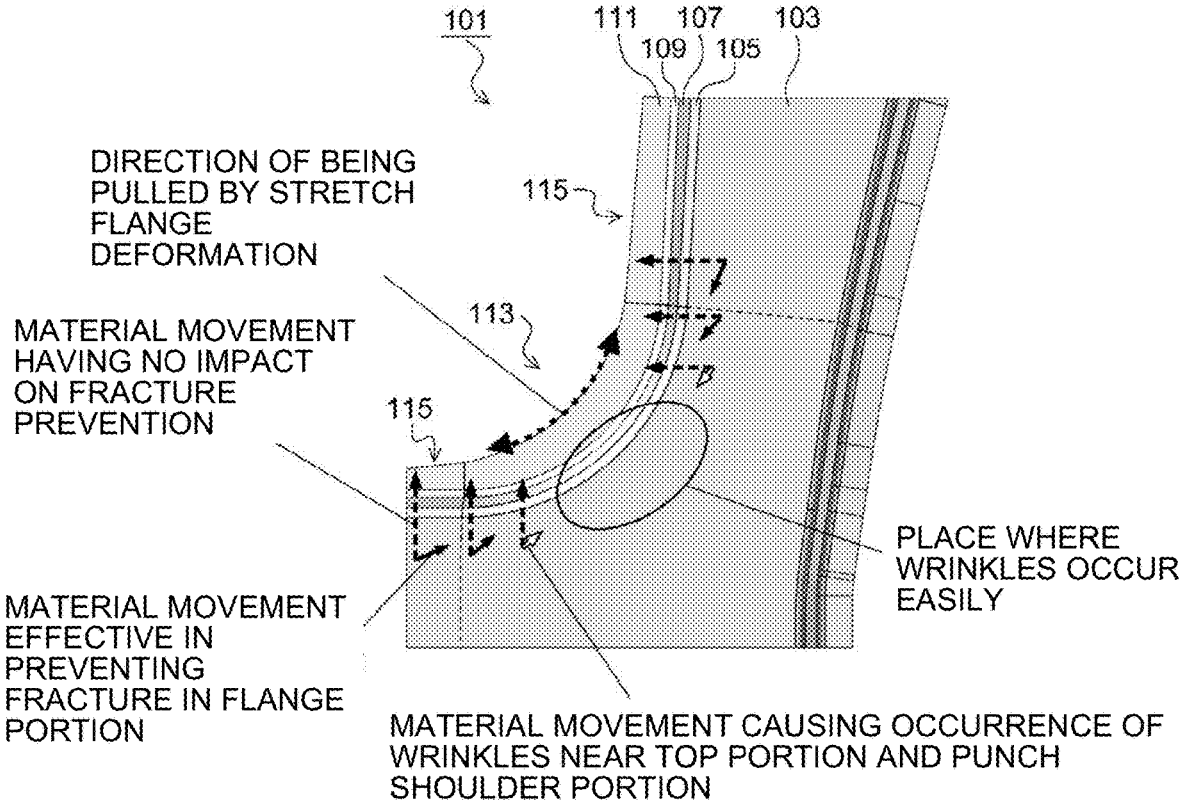
FIG. 11 is a diagram explaining material movements in press forming of a press formed product that is concave and curved in the top view.

Even if a fracture of the flange portion 111 and wrinkles of the top portion 103 and the punch shoulder portion 105 occur in the curved portion 113 of the press formed product 101 when the press formed product 101 with the target shape of the bending radius of the conventional punch shoulder portion 105 illustrated in FIG. 9 is press formed at a single step, according to the press forming method of the present invention, the press formed product 101 having a target shape can be obtained while a fracture of the flange portion 111 and wrinkles of the top portion 103 and the punch shoulder portion 105 are prevented in the curved portion 113.

Likewise, the present invention includes a press forming method in which, for example, the press formed product 21 illustrated in FIG. 3 as an intermediate formed product and the intermediate formed product is press formed into the press formed product 101 (FIG. 9) having a target shape, the press formed product 21, which is an intermediate formed product, has a bending radius of the die shoulder portion 29 in the center of the curved portion 33 larger than the target shape has. In other words, the present invention includes a press forming method made up of two steps: a step of press forming the press formed product 21, which is an intermediate formed product; and a step of press forming the press formed product 21 into the press formed product 101 having a target shape.

In this case also, a fracture of the flange portion 111 and wrinkles of the top portion 103 and the punch shoulder portion 105 still occur in the curved portion 113 when the press formed product 101 with the target shape of the bending radius of a conventional die shoulder portion 109 is formed at a single step. According to the present invention, however, the press formed product 101 having a target shape can be obtained while a fracture of the flange portion 111 and wrinkles of the top portion 103 and the punch shoulder portion 105 are further prevented in the curved portion 113.

The press forming method and the press formed products according to the present invention have no particular restrictions on the type of metallic sheet used as the blank material, but can be preferably applied when a metal sheet having low elongation is used. Specifically, a metal sheet having a tensile strength of 440 MPa grade or higher to 1600 MPa grade or lower and a sheet thickness of 0.5 mm or higher to 3.6 mm or lower is preferably used.

A metal sheet having a tensile strength of less than 440 MPa grade is less likely to have a fracture due to stretch flange deformation because of its high elongation, so there is little advantage in using the present invention. However, if a part shape is difficult to press form, using the present invention is preferable even if the metal sheet has a tensile strength of less than 440 MPa grade. Although there is no particular upper limit to the tensile strength, a metal sheet exceeding the 1600 MPa grade has poor elongation and is prone to a fracture in the punch shoulder portion and the die shoulder portion, making press forming difficult.

The press forming method and the press formed product according to the present invention can also prevent a fracture of metal sheets due to stretch flange deformation in automotive parts having L-, T-, Y-, or S-shaped portions that are curved in the top view. As specific examples, the present invention can preferably be applied to cases where an A-pillar lower having an L-shaped part, a B-pillar having a T-shaped part, a rear side member having an S-shaped part, and the like.

EXAMPLES

Specific press forming experiments have been conducted, and the operation and effect of the press forming method according to the present invention will be described below.

In the press forming experiments, steel sheets having the material properties illustrated in Table 1 were used as blanks, the press formed product 1 (FIG. 1), the press formed product 21 (FIG. 3), the press formed product 41 (FIG. 5), and the press formed product 61 (FIG. 6) illustrated in the embodiment describe above were used as press forming objects, and went through crash forming, to provide invention examples.

The radius of the curve of the curved portion in the height center of the side wall portion of each press formed product was 153 mm, the smallest bending radius of the punch shoulder portion in the curved portion was 7 mm, the smallest bending radius of the die shoulder portion was 6 mm, a side wall height of the side wall portion in the press forming direction was 60 mm. The flange width of the flange portion was 30 mm in the center of the curve and 25 mm on the end sides of the curve for the press formed product 1, and was 10 mm in the center of the curve and 25 mm on the end sides of the curve for the press formed products 21, 41, and 61.

TABLE 1

| Sheet thickness/mm | Yield strength/MPa | Tensile strength/MPa | Stretch/% |
|---|---|---|---|
| 1.6 | 880 | 1210 | 13 |

Tables 2 and 3 illustrate the bending radius $R_p$ of the punch shoulder portion and the bending radius $R_d$ of the die shoulder portion in the press formed products used as press forming objects in the press forming experiments. The ratios of the bending radius $R_p$ of the punch shoulder portion illustrated in Tables 2 and 3 are the ratios of the largest bending radius to the smallest bending radius in the ridge direction of the punch shoulder portion. Likewise, the ratios of the bending radius $R_d$ of the die shoulder portion illustrated in Tables 2 and 3 are the ratios of the smallest bending radius to the largest bending radius in the ridge direction of the die shoulder portion.

Furthermore, in the press forming experiments, as a comparison object, the press formed product 101 was set to Conventional Example 1, the press formed product 101 being press formed by holding the portion corresponding to the top portion 103 of the press formed product 101 illustrated in FIG. 9 with a pad while allowing rotational motion of the blank in the horizontal plane parallel to the top portion 103 by following the method disclosed in the Patent Literature 1.

In Conventional Example 1, the curvature radius of the curve of the curved portion 113, the bending radius of the die shoulder portion 109, and the side wall height of the side wall portion 107 were the same as for the press formed product according to the invention examples. In Conventional Example 1, the smallest bending radius of the punch shoulder portion 105 was set constant (=7 mm) in the ridge direction.

Then, a fracture and wrinkles were evaluated in each of the press formed products according to the invention examples and the conventional examples. To evaluate a fracture, a sheet thickness reduction rate was calculated by dividing the difference between the sheet thickness of the blank and the sheet thickness of the tip (for example, part C illustrated in FIG. 2) of the flange portion at the bottom of the concave portion in the curved portion by the sheet thickness of the blank. A smaller value was evaluated to be the better for fracture prevention. To evaluate wrinkles, sensory evaluation of the top portion and the punch shoulder portion in the curved portion was performed visually. A "X" was given when there were significant wrinkles, a "Δ" when there were minute wrinkles that can be visually confirmed but is acceptable in terms of part performance, and a "○" when wrinkles could not be visually confirmed. Tables 2 and 3 illustrate the results of a fracture and wrinkles evaluated for each press formed product.

TABLE 2

| | No. | | | | | | |
|---|---|---|---|---|---|---|---|
| | Conventional Example 1 | Invention Example 1 | Invention Example 2 | Invention Example 3 | Invention Example 4 | Invention Example 5 | Invention Example 6 |
| Details | Rotational motion of the blank was allowed during press forming | Bending radius $R_p$ of the punch shoulder portion was increasing in the curved portion | ← | ← | Bending radius $R_p$ of the punch shoulder portion and the bending radius $R_d$ of the die shoulder portion were increasing in the curved portion | ← | ← |
| Ratio of the bending radius $R_p$ of the punch shoulder portion | 1.0 | 1.1 | 1.5 | 2.0 | 1.5 | ← | ← |
| Ratio of the bending radius $R_d$ of the die shoulder portion | 1.0 | ← | ← | ← | 0.9 | 0.75 | 0.5 |
| Fracture evaluation (sheet thickness reduction rate (%)) | 18 | 17 | 14 | 12 | 13 | 12 | 10 |
| Sensory evaluation for wrinkles | Δ | ○ | ○ | ○ | ○ | ○ | ○ |

TABLE 3

| | No. | | | | | |
|---|---|---|---|---|---|---|
| | Invention Example 7 | Invention Example 8 | Invention Example 9 | Invention Example 10 | Invention Example 11 | Comparative Example 1 |
| Details | Bending radius $R_p$ of the punch shoulder portion and the bending radius $R_d$ of the die shoulder portion were increasing in the curved portion + rotational motion of the blank was restrained | ← | Excess metal was given to the blank of Invention Example 2 | Excess metal was given to the blank of Invention Example 5 | Excess metal was given to the blank of Invention Example 7 + rotational motion of the blank was restrained | Bending radius $R_p$ of the punch shoulder portion in the entire part was uniformly increased (1.5 times) |
| Ratio of the bending radius $R_p$ of the punch shoulder portion | 1.5 | ← | ← | ← | ← | 1.0 |
| Ratio of the bending radius $R_d$ of the die shoulder portion | 0.75 | ← | 1.0 | 0.75 | ← | 1.0 |
| Fracture evaluation (sheet thickness reduction rate (%)) | 14 | 14 | 9 | 7 | 9 | 9 |
| Sensory evaluation for wrinkles | ○ | ○ | ○ | ○ | ○ | x |

In Conventional Example 1, the sheet thickness reduction rate was as large as 18% and minute wrinkles occurred.

In Invention Example 1, the press formed product 1 was press formed with the bending radius $R_p$ of the punch shoulder portion 5 increased at a ratio of 1.1 from the center of the curve toward the end sides of the curve. As illustrated in Table 2, the sheet thickness reduction rate was 17%, which was less than that of Conventional Example 1, and no wrinkles were observed.

In Invention Example 2, the ratio of the bending radius $R_p$ of the punch shoulder portion 5 was set at 1.5, which was larger than that of Invention Example 1. As illustrated in Table 2, the sheet thickness reduction rate was 14%, which was less than that of Invention Example 1, and no wrinkles was observed.

In Invention Example 3, the press formed product 1 was press formed with the bending radius $R_p$ of the punch shoulder portion 5 increased from Invention Example 2 at a ratio of 2.0. As illustrated in Table 2, the sheet thickness reduction rate was 12%, which was much less than that of Invention Example 2, and no wrinkles were observed.

In Invention Example 4, the press formed product 21 was pressed with the bending radius $R_p$ of the punch shoulder portion 25 increased at a ratio of 1.5 from the center of the curve toward the end sides of the curve and the bending radius $R_d$ of the die shoulder portion 29 decreased at a ratio of 0.9 from the center of the curve toward the end sides of the curve. As illustrated in Table 2, the sheet thickness reduction rate was 13%, which was less than that of Invention Example 2 the ratio of the bending radius $R_p$ of the punch shoulder portion 25 of which was the same, and no wrinkles were observed.

In Invention Example 5, the press formed product 21 was press formed with the bending radius $R_d$ of the die shoulder portion 29 decreased from Invention Example 4 at a ratio of 0.75. As illustrated in Table 2, the sheet thickness reduction rate was 12%, which was less than that of Invention Example 4, and no wrinkles were observed.

In Invention Example 6, the ratio of the bending radius $R_d$ of the die shoulder portion 29 was set at 0.5, which was much less than that of Invention Example 5. As illustrated in Table 2, the sheet thickness reduction rate was 10%, which was less than that of Invention Example 5, and no wrinkles were observed.

In Invention Example 7, the press formed product 41 was press formed with the bending radius $R_p$ of the punch shoulder portion 45 set at a ratio of 1.5, the bending radius of a die shoulder portion 49 set at a ratio of 0.75, and the rotational motion restraining shape portion 57 formed between the top portion 43 and the side wall portion 59. As illustrated in Table 3, the sheet thickness reduction rate was 14%, which was less than that of Conventional Example 1, and no wrinkles were observed.

In Invention Example 8, the press formed product 61 was press formed with the ratios of the bending radius $R_p$ of the punch shoulder portion 45 and the bending radius of the die shoulder portion 49 set equal to those of Invention Example 7, and the rotational motion restraining shape portion 63 having a bead shape formed from the end sides of the curve to the straight portions in the top portion 43. As illustrated in Table 3, the sheet thickness reduction rate was 14%, which was less than that of Conventional Example 1, and no wrinkles were observed.

In Invention Example 9, the press formed product 71 was press formed using the blank 95 having a shape in which excess metal was given to the flange equivalent portion 97, with the bending radius of the punch shoulder portion 75 set at a ratio of 1.5 and the flange width of the flange portion 81 in the center of the curved portion 83 set at 1.5 times the flange width (=25 mm) on the end sides of the curve. As illustrated in Table 3, the sheet thickness reduction rate was reduced to 9%, which was good, and no wrinkles were observed.

In Invention Example 10, the press formed product 21 was press formed using the blank 95 having a shape in which excess metal was given to the flange equivalent portion 97, with the bending radius of the punch shoulder portion set at a ratio of 1.5 and the bending radius $R_d$ of the die shoulder portion set at a ratio of 0.75, as in Invention Example 5. As illustrated in Table 3, the sheet thickness reduction rate was 7%, which was much less than that of Invention Example 9, and no wrinkles were observed.

In Invention Example 11, the press formed product 21 was press formed using the blank 95 having a shape in which excess metal was given to the flange equivalent portion 97, with the bending radius of the punch shoulder portion set at a ratio of 1.5, the bending radius $R_d$ of the die shoulder portion set at a ratio of 0.75, as in Invention Example 7, and the rotational motion restraining shape portion 57 formed. As illustrated in Table 3, the sheet thickness reduction rate was reduced to 9%, which was good, and no wrinkles were observed.

An example of the press formed product 101 in which the bending radius $R_p$ of the punch shoulder portion 105 was uniformly increased as compared with that of Conventional Example 1 is illustrated in Table 3 as Comparative Example 1. In Comparative Example 1, the bending radius of the ridge of the entire punch shoulder portion 105 in Conventional Example 1 was increased by 1.5 times to a constant 10.5 mm. As a result, the sheet thickness reduction rate was 9%, which was good, but significant wrinkles problematically occurred.

It has been demonstrated that the press forming method and the press formed products can prevent a fracture of the flange portion in the curved portion and prevent wrinkles of the top portion and the punch shoulder portion in the curved portion.

INDUSTRIAL APPLICABILITY

According to the present invention, a press forming method and a press formed product can be provided, the press forming method by which, in the press formed product that has a top portion, a side wall portion, and a flange portion and that is concave and curved in the top view, a fracture can be prevented in the flange portion where stretch flange deformation occurs and wrinkles can be prevented in the top portion and the punch shoulder portion on the flange portion side.

REFERENCE SIGNS LIST

1 Press formed product
3 Top portion
5 Punch shoulder portion
7 Side wall portion
9 Die shoulder portion
11 Flange portion
13 Curved portion
15 Straight portion
21 Press formed product
23 Top portion
25 Punch shoulder portion
27 Side wall portion
29 Die shoulder portion
31 Flange portion
33 Curved portion
35 Straight portion
41 Press formed product
43 Top portion
45 Punch shoulder portion
47 Side wall portion
49 Die shoulder portion
51 Flange portion
53 Curved portion
55 Straight portion
57 Rotational motion restraining shape portion
59 Side wall portion
61 Press formed product
63 Rotational motion restraining shape portion
71 Press formed product
73 Top portion

75 Punch shoulder portion
77 Side wall portion
79 Die shoulder portion
81 Flange portion
83 Curved portion
85 Straight portion
91 Blank
93 Flange equivalent portion
95 Blank
97 Flange equivalent portion
101 Press formed product
103 Top portion
105 Punch shoulder portion
107 Side wall portion
109 Die shoulder portion
111 Flange portion
113 Curved portion
115 Straight portion

The invention claimed is:

1. A press forming method comprising:

press forming a workpiece to form a press formed product including:

a top portion, a side wall portion continuous from the top portion through a punch shoulder portion, a flange portion continuous from the side wall portion through a die shoulder portion, and a curved portion that is concave and curved in a top view, the curved portion being a curved L-shape in the top view, wherein the punch shoulder portion is formed such that a bending radius of the punch shoulder portion in the curved portion increases from a center of a curve toward both end sides of the curve.

2. The press forming method according to claim 1, wherein the die shoulder portion is formed such that a bending radius of the die shoulder portion in the curved portion increases from the center of the curve toward an end side of the end sides of the curve.

3. The press forming method according to claim 1, wherein the die shoulder portion is formed such that a minimum bending radius of the die shoulder portion smaller than a minimum bending radius of the punch shoulder portion.

4. The press forming method according to claim 1, comprising forming a rotational motion restraining shape portion that restrains rotational motion of a blank during a press forming process on the top portion on an end side of the end sides of the curve.

5. The press forming method according to claim 4, wherein the rotational motion restraining shape portion is a bent shape formed between an other side wall portion and the top portion, the other side wall portion being at an opposite side of the top portion from the side wall portion.

6. The press forming method according to claim 4, wherein the rotational motion restraining shape portion has a bead shape formed on the top portion.

7. The press forming method according to claim 1, wherein the flange portion is formed such that a flange width of the flange portion in the curved portion wider in the center of the curve than on an end side of the end sides of the curve.

8. The press forming method according to claim 1, wherein a blank to be used for press forming of the workpiece is a metal sheet having a tensile strength of 440 MPa grade or higher to 1600 MPa grade or lower.

9. A press forming method, comprising press forming an intermediate formed product using the press forming method according to claim 1; and forming a final product from the intermediate formed product, the final product including:

a top portion, a side wall portion continuous from the top portion through a punch shoulder portion; and a curved portion that is concave and curved in a top view, the curved portion being a curved L-shape in the top view, wherein the intermediate formed product has a bending radius of the punch shoulder portion on one end side of the end sides of the curved portion larger than a bending radius of the punch shoulder portion on an end side of the curved portion of the final product.

10. A press formed product comprising:

a top portion;

a side wall portion continuous from the top portion through a punch shoulder portion;

a flange portion continuous from the side wall portion through a die shoulder portion; and a curved portion that is concave and curved in a top view, the curved portion being a curved L-shape in the top view, wherein a bending radius of the punch shoulder portion in the curved portion increases from a center of a curve toward both end sides of the curve.

11. The press formed product according to claim 10, wherein a bending radius of the die shoulder portion in the curved portion decreases from the center of the curve toward an end side of the end sides of the curve.

12. The press formed product according to claim 10, wherein a minimum bending radius of the die shoulder portion is smaller than a minimum bending radius of the punch shoulder portion.

13. The press formed product according to claim 10, further comprising a rotational motion restraining shape portion that restrains rotational motion of a blank during a press forming process on the top portion on an end side of the end sides of the curve.

14. The press formed product according to claim 13, wherein the rotational motion restraining shape portion is a bent shape formed between an other side wall portion and the top portion, the other side wall portion being at an opposite side of the top portion from the side wall portion.

15. The press formed product according to claim 13, wherein the rotational motion restraining shape portion has a bead shape formed on the top portion.

16. The press formed product according to claim 10, wherein a width of the flange portion in the curved portion is wider in the center of the curve than on an end side of the end sides of the curve.

17. The press formed product according to claim 10, wherein the press formed product comprises a metal sheet having a tensile strength of 440 MPa grade or higher to 1600 MPa grade or lower.

* * * * *